United States Patent [19]

Cook

[11] Patent Number: 4,638,571

[45] Date of Patent: Jan. 27, 1987

[54] RADIO FREQUENCY NOZZLE BAR DRYER

[76] Inventor: William A. Cook, 2105 Swinnen Dr., Wilmington, Del. 19810

[21] Appl. No.: 847,208

[22] Filed: Apr. 2, 1986

[51] Int. Cl.[4] ..... F26B 3/34

[52] U.S. Cl. ..... 34/1; 34/68; 219/10.61 R; 219/10.81

[58] Field of Search ..... 34/1, 68, 156, 160; 219/10.61, 10.81

[56] References Cited

U.S. PATENT DOCUMENTS

| | | | |
|---|---|---|---|
| 3,722,105 | 3/1973 | Marteny | 34/1 |
| 3,953,701 | 4/1976 | Manwaring | 219/10.61 |
| 4,218,830 | 8/1980 | Grassman | 219/10.81 |
| 4,257,167 | 3/1981 | Grassman | 34/68 |

*Primary Examiner*—Larry I. Schwartz

*Attorney, Agent, or Firm*—Edward J. Kaliski

[57] ABSTRACT

Enhancement of the conventional nozzle bars in an air flotation, high speed air impingement web dryer by adding an electrode insulatedly mounted on the conductive surface of the nozzle bar which is in proximity to the web and establishing a plurality of radio frequency fringing electric fields to intercept the web and enhance the drying process is disclosed. The R.F. fields are powered by an integral R.F. generator electrically connected between the insulated electrode and the conductive nozzle bar housing. The system permits the beneficial characteristics of dielectric drying to be added to the conventional air impingement web dryer with minimum re-arrangement problems and maximum power profiling versatility. A further circuit characteristic provides for substantially constant dielectric power transfer to the web independent of variations in the nozzle bar to web spacing.

8 Claims, 13 Drawing Figures

RADIO FREQUENCY NOZZLE BAR DRYER

BACKGROUND OF THE INVENTION

1. Field of Invention

This invention relates generally to methods for treating continuously moving webs. In particular, it is concerned with tunnel drying of webs previously coated with a liquid medium. It combines the effects of gaseous fluid impingement which treats the web and optionally supports it with high frequency energy input to the web, preferably radio frequency (R.F.), which enhances the treatment.

2. Prior Art

High speed air impingement dryers are widely used in industry to dry a variety of web products such as paper, photographic films, coated fabrics, et cetera. In their more advanced form, the air jets from the nozzle bars are used also to float and position the web as it moves along the drying path thus avoiding mechanical contact with the web and reducing web tension build up through the dryer. In this form, such dryers provide generally good service and drying speed. Like all air drying systems, however, they are subject to several inherent limitations:

(a) The product must be over-dried in part to insure that any wetter or heavier coated areas are fully dried before exiting the dryer to other in-line processing steps or a windup. This is particularly troublesome when the process web contains anomalously heavier coated areas such as edges, coater skips, or splashes. In many cases, such anomalies determine the maximum process speed rather than the normal product drying.

(b) To obtain higher drying speeds for a given dryer path length, the operator's only routes are to increase the air jet velocities or the air temperature. Neither can be increased indefinitely since excessive values of either may damage the coating or the base web.

(c) As the drying speed is pushed higher, the problem of "skinning" of an initially wet coating surface becomes more pronounced. When all or most of the drying energy is transferred through the surface, a moisture gradient is set up in the coating thickness. This causes the surface to become drier than the bulk of the coating and thus lose mobility in the critical early drying phases. This prevents the surface tension in the coating from acting beneficially to smooth out surface irregularities that occur naturally in any coating process. The action described has been observed by most people in seeing brush marks gradually disappear from a slowly drying varnish coating.

Many of the difficulties in air or radiant dryers described above can be alleviated by introducing dielectric heating energy into the web during the drying process. To be beneficial, this additional input need only represent a portion of the total energy needed to evaporate the solvent from the web. In most practical applications, a good volume of air impingement flow onto the web must be maintained to dilute and carry off the evaporated solvent. The general characteristics of dielectric drying which make it useful in process drying have been well covered in the literature and patent art. Briefly, these factors are:

(a) In the typical case where the wet coating is the principal R.F. lossy energy receptor, dielectric heating will provides a compensating action to level the drying of coating anomalies across and along the web. This is a result of the energy being selectively absorbed proportional to the amount of the dielectrically lossy solvent locally present in the web.

(b) Because the dielectric energy is liberated directly in the bulk of the web or coating, a more uniform moisture gradient in the thickness direction is achieved. This reduces the "skinning" effect described earlier and usually results in improved surface smoothness in coated webs.

(c) A higher rate of energy input for faster drying can often be achieved because the dielectric coupling bypasses the limitations of conventional convective heat transfer. Thus, air velocities or temperatures of the air impingement dryer which may be excessively high for the product are avoided.

Because the benefits of dielectric drying previously described are generally well known in the process drying industries, much effort has been expended over the years towards developing improved dielectric dryers both in the radio frequency and microwave areas. Some efforts have been quite successful but many have been abandoned for a variety of reasons. Those familiar with the art will generally agree the following difficulties are common:

(a) A dielectric dryer design for a given application generally turns out to be a custom engineering and process development effort and is, therefore, usually time consuming and costly.

(b) With conventional dielectric dryers, it is difficult to predict the energy input profile along the dryer path and just as difficult to adjust it after the process is put in operation. For sensitive products, this represents a very high technical risk for the plant operator who is attempting to obtain some of the the inherent benefits of dielectric heating. As a result, most process operators opt for a system using only air impingement drying since it can be engineered faster and more predictably.

Most of these difficulties stem from the design of the conventional radio frequency web dryer. Typically it consists of a ladder-like array of alternating electrically "hot" and grounded electrodes which establish a fringing electric field to intercept the proximate process web. The electrodes are bussed together on heavy R.F. conductor systems to a common radio frequency power generator. R.F. generator powers in the 10 kilowatt to 50 kilowatt range are fairly common in the industry. In this arrangement, it is difficult to extend the applicator length or remote the common generator more than about one-quarter wavelength of the operating frequency because of the voltage standing wave effects that are encountered. In such an arrangement, the voltage level across each electrode pair and hence the R.F. electric field is substantially the same throughout the whole array. The overall level can be adjusted from the common generator or through various circuit coupling means known in the art. With this arrangement, the difficulty in predicting or controlling the power input to the web along its drying path through the electrode system stems from two major effects. First, the local energy coupling to the web will vary strongly as the inverse of the gap between the electrode pair and the web. Thus, if the planarity or positioning of the web is less than perfectly controllable, the local energy input will also be uncontrollable. The second factor has to do with the complex nature of the dielectric loss factor of the material which is the receptor for the energy. In R.F. systems, this is usually a partially conductive solvent containing ionic solutes. In microwave systems, additional mechanisms come into play such as polar molecule coupling. The amount of energy locally transferred depends simultaneously on the local conditions of solvent quantity, its solute concentration, and its temperature. All these factors are varying along the dryer path in a complex and interdependent manner.

What is needed by the drying industry is an efficient approach to combining the best features of air impingement drying with the best features of dielectric drying. When used in combination, a synergism results to produce a drying system superior to either approach used alone. Both mediums contribute to the total energy transfer to the web. The R.F. contributes to leveling of coating anomalies while the air impingement carries off evaporated solvent and helps maintain the coating temperature nearer the dew point rather than its boiling point.

There have been some efforts in the industry to achieve this goal and get around the engineering and process problems associated with combining air impingement and dielectric drying. One such approach is described in U.S. Pat. No. 4,257,167 issued to H. C. Grassmann. In that approach, individual air impingement nozzle bars of an approximately conventional design are made to act as alternate polarity electrode bars of a stray field R.F. coupler. The active fringing R.F. field is established between the separate nozzle bars. This generally leads to inefficient dielectric energy coupling because the optimum nozzle bar spacing is usually too large to establish an optimum R.F. field. Grassman partially overcomes this by showing optional satellite electrode bars added between the nozzle bars. The entire set of nozzle bars acting as electrodes is driven from a common R.F. power generator as in a conventional R.F. stray field ladder electrode.

Although the arrangement described by Grassman will provide a route to achieving a potentially useful combination of air impingement and dielectric drying, it is still subject to all the engineering and process problems ascribed earlier to dielectric dryers. These include the problems of distributing substantial amount of R.F. power from a remote generator over the length of a tunnel dryer which might extend hundreds of feet. The arrangement also precludes much versatility in experimenting with the optimum number and placement of R.F. heating zones in an existing long tunnel dryer and establishing a controllable power transfer profile along that length.

Others have attempted to achieve combined air flow and dielectric drying by utilizing microwave power sources. Such microwave applicators, typically utilizing serpentine wave guide sections experience great difficulty in providing controlled distribution of energy input both across and along the web in the processing zone.

3. Definitions

Nozzle Bar, as referred to herein, means a structure, usually elongated, disposed transversely to the path of the moving web and in close proximity thereto. It provides jets of gas through one or more slot or hole orifices to impinge on a proximate web. This impinging flow is typically used to heat, condition, or dry the web. In addition, the kinetic energy of the gas flow may be directed so as to create a zone of pressure higher than ambient to provide mechanical positioning and/or support of the moving web.

Air, as referred to herein, means any gaseous fluid capable of transporting sensible or latent heat to or from the web and usually is capable of transporting any solvent vapors released from the web to collection points away from the processing area. In a typical application, the gas is air of a controlled temperature and humidity.

Proximate, as referred to herein, means the region between the nozzle bar and the web within the area projected by the individual nozzle bar structure on the web. Depending on the portion of the discussion, it may be used in conjunction with the web surface, working surface of the nozzle bar, or the space between these two. This is the region wherein the impingement gas jets provide the bulk of their heat transfer action and, also, provide any pressure support for web positioning if that feature is included in the design.

Radio Frequency (or R.F.), as referred to herein, means an electrical voltage or current whose polarity is reversing periodically with time. A generally accepted frequency of reversal for R.F. is approximately 0.5 Megahertz to approximately 500 Megahertz. For industrial heating applications there are legal and technical preferences for operating at one of the ISM (Industrial, Scientific, and Medical) bands allocated in Part 18 of the Federal Communications Commission regulations.

SUMMARY OF THE INVENTION

It is the object of the invention to provide a method and apparatus to permit a process web drying operator to obtain the benefits inherent in the combination of air impingement and dielectric drying in a manner which avoids the major technical and economic problems of previously existing approaches. In addition to its process advantages, the new approach described below will provide significant commercial advantages to the owner of an existing conventional air impingement/flotation dryer wishing to upgrade its performance with minimum technical risk and lost production time.

This objective is accomplished by the instant invention of an apparatus which combines both the ducting and impingement air jets of a conventional nozzle bar with a self-contained radio frequency energy applicator. The conductive, typically metallic, sides and top edge of the housing and nozzle edges are utilized to form a pair of electrodes, conveniently operated at electrical ground potential. A single or multiple conductor bar is located centrally on the surface of the nozzle bar assembly which is proximate to the process web. This conductive bar acts as the electrically "hot" electrode. A radio frequency generator, preferably located inside the envelope of the nozzle bar housing, supplies high frequency power to this electrode and sets up fringing R.F. electric fields with each of the side ground electrodes which are the adjacent areas of the nozzle structure which are connected to the generator as well. These fringing electric fields are confined substantially to the proximate space between the nozzle bar and the web. They intercept and penetrate the proximate web undergoing drying and couple additional energy to it by the same dielectric loss mechanisms as other dielectric dryers.

A unique feature of the electrical circuitry of the invention is that it intrinsically senses and adjusts the R.F. electric field intensity existing across the electrode pairs if the proximate web varies its distance from the electrode faces. It does this in such a manner that the nominal level of the power transfer from the device to the web remains substantially constant over normal gap variations. It is possible, also, to adjust the nominal power level of transfer by externally varying the D.C. supply voltage to the circuit thereby permitting the power level along the drying path to be profiled for optimum process drying results.

The above features can be realized in an assembly whose external envelope is substantially the same as a conventional nozzle bar. In most cases, the assembly can be arranged to bolt into the mounting position and substitute for any conventional nozzle bar in an existing air flotation dryer. It can connect, without modification, to the existing air supply duct connector. The only required modifications to an existing machine would be the addition of low voltage D.C. power supply and optional control cables through the dryer tunnel. Operating safety would also make it prudent to add electrical interlocks on close by operator access doors. It will be necessary also to verify the electrical shielding integrity of the dryer tunnel or process enclosure to insure no excessive level of electromagnetic radiation can escape to the environment.

Given the features described above, the objectives of the invention can be realized in a straight forward manner.

(a) The unitized assemblies, if used as direct, bolt-in replacements for conventional nozzle bars, will permit simple, low risk development of critical process/product parameters by direct on-line tests. The units can be quickly installed in various numbers or positions and evaluated. So called "A/B" test comparisons may be obtained with "air only" drying simply by turning off the electrical power. If for some reason, the supplemental R.F. energy input causes detrimental effects, normal production can be resumed simply by turning off the electrical power or re-bolting the conventional nozzle bars in place.

(b) By providing integral R.F. generators in each R.F./Nozzle bar module, the assemblies can be utilized over very long tunnel lengths in any positional arrangement without encountering the technical problems and costs attendant to bussing all the bars from a remote common R.F. generator.

(c) The use of low power individual generators in each module provides two useful characteristics that were not available in the previous art. First, the power level of each assembly may be made different or remotely adjustable so that a specific R.F. power input profile can be established along the dryer path length. This can be particularly useful in the processing of sensitive products. Secondly, as each module power supply is limited in its total output, it is unlikely an anomalous heavy coating defect can cause a catastrophic energy input wherein all the available power of a large common R.F. generator is drawn into one small portion of the web.

(d) The electrical circuit features which maintain the transferred power substantially constant independent of typical gap variations will provide the dryer operator a wider process latitude than has been available with previous art. By reducing the effects of web tension, product changes et cetera which can all affect the gap variations, it should be possible to improve process efficiency and quality control.

(e) By incorporating the fringing field electrode elements in the proximate face of the nozzle bar several important advantages are obtained over previous art.

The nominal electrode to web gap is generally smaller and better controlled in this region than in the space between nozzle bars. The smaller gap provides better electrical coupling than larger gaps. Also, the proportioning between the spacing of the electrode elements, gap, and material dielectric loss characteristics may be optimized for a given application independent of the impingement air jet design or the nozzle bar to nozzle bar spacing.

The overall result of the present invention as a consequence of the features described is to provide the web drying industry with a approach which will secure the maximum benefits of combined air impingement and R.F. drying without the costly detriments and technical risks associated with the previous art.

DETAILED DESCRIPTION OF THE DRAWINGS

Figure 1:
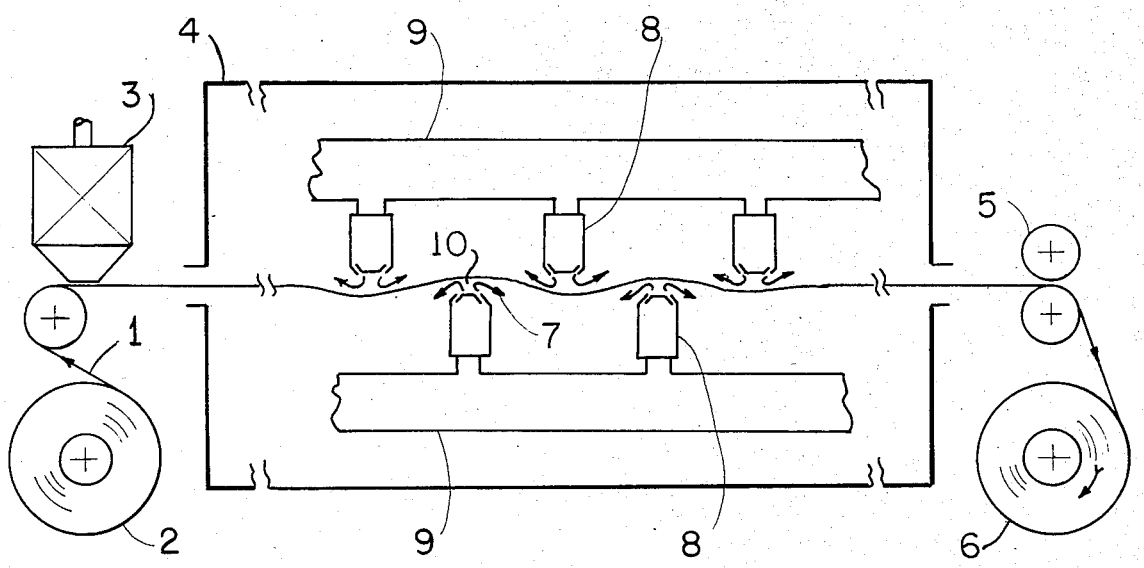
PRIOR ART FIG. 1
FIG. 1 is a schematic side elevation view of a tunnel dryer utilizing conventional nozzle bars of the prior art for providing the drying action and mechanical support of the moving web.

FIG. 1 shows the schematic arrangement of a typical air impingement flotation dryer. A base web 1 is supplied from either a continuous production process or a supply roll 2. The web 1 passes through a coating station 3 where some material to enhance the final product properties is applied to one or both sides of the base web surface. The design of the coating station may take many forms depending on the nature of the coating. From the coating station, the coated web passes in a dryer tunnel 4 whose length is appropriate for the web speed and drying rate. In the tunnel, energy is transferred into the web to effect heating, drying, and possibly curing of the coated product. Typically, the major thermal load is evaporating a carrier solvent which is applied as part of the coating mix. In other cases, a liquid may be present in the base web which must be dried even without a coating applied. An example of this is evaporating the water from a web of paper.

Upon completing the path through the dryer tunnel 4, the product web should be satisfactorily dried. After exiting, it usually passes across rollers 5 to provide traction, tension isolation, or web guidance. From there, the web typically is passed to a product windup 6 or directly to further in-line finishing steps.

In such an air impingement flotation dryer, the energy transfer is effected by the action of high velocity gas streams 7 impinging on one or both sides of the web from a series of nozzle bars 8 spaced along the the web path on one or both sides. Generally the gas is air whose temperature and humidity is controlled and supplied to the individual nozzle bars by one or more distribution ducts 9. Velocities of the impingement air issuing from the nozzle slots may range from approximately 200 to 6,000 feet per minute depending on the application. In addition to impinging the gas stream on the product web for good heat transfer, the nozzle bars 8 also may perform the function of supporting the web as it passes through the dryer tunnel length. This is accomplished by creating a zone 10 of increased gas pressure between the working face of the nozzle bar and the adjacent section of product web. In general, for this flotation support action to be achieved, nozzle jets on opposing sides of the working face must have a component of tangential velocity directed inward to the centerline of the nozzle bar. This is to overcome the Bernoulli effect of the accelerating gas flow as it escapes the zone 10 between the bar face and the web which, if not counteracted, would cause the web to be drawn against the bar. Requirements and various design approaches to accomplish a stable web support with good gas-to-web heat transfer are well known in the art.

Figure 2:
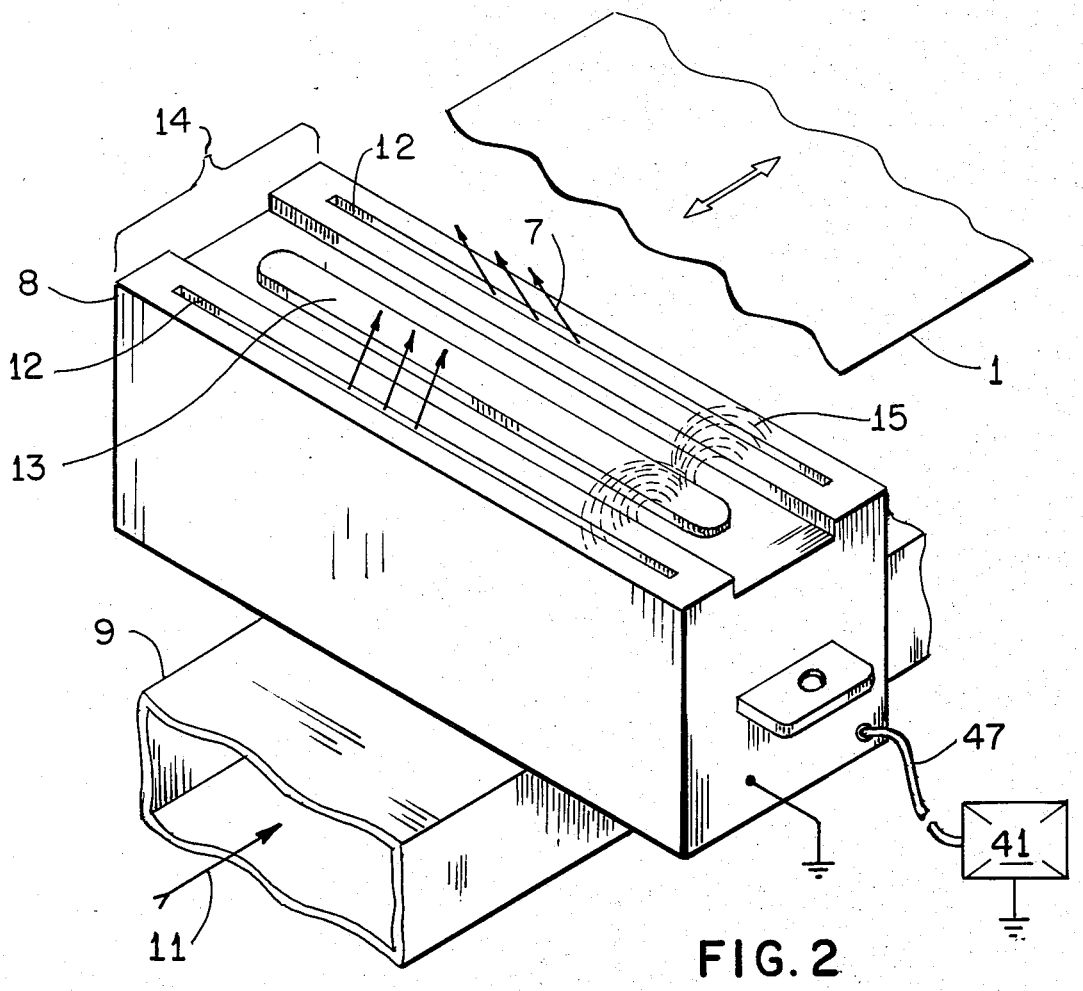
FIG. 2 is a perspective view of the nozzle bar with added radio frequency heating applicator enhancement of the subject invention.

In the present invention, the physical envelope, air impingement action, and web flotation action are still present in essentially the same form as the prior art. The nozzle bar, however, provides for the addition of a high frequency electric field to be present in the proximate space of the nozzle bar and web. That is to say the space between the working face of the bar and its projection on the product web. This is illustrated in FIG. 2. The nozzle bar assembly 8 is typically of similar physical outline to regular air impingement nozzle bar and mechanically supported on tunnel rails etc. in the same way. Conditioned drying air 11 is transferred from the common distribution duct 9 via an aperture connection to the bar not shown in this view and is then distributed internally within the bar. After traversing the internal passages within the nozzle bar body, the air exits uniformly from nozzles 12 along the bar length. These nozzles are shown as the typical slot jets but may take the form of a series of hole orifices or other perforations as is known in the art. Air flow 7 exiting the nozzles is partially indicated by the arrows. The nozzle bar assembly 8 is positioned transversely across the dirction of motion of the product web 1 as is known in the art.

Unlike a conventional nozzle bar, the present invention provides one or more electrically isolated electrode bars 13 which extend along the assembly length on its working face 14, said face 14 being the one which is in proximity to the process web 1. A high frequency electrical generator, not shown in this figure, preferably housed inside the body of the nozzle bar 8, is connected to establish a high frequency, preferably in the radio frequency range, high intensity, alternating electric field 15 between the electrode 13 and the electrically conductive nozzle bar assembly body components 8. Preferably, the nozzle bar assembly is held at ground potential for safety and electrical convenience. The electric field 15 which is partially shown as dotted lines has field lines which extend into the electrically non-conductive dielectric space between the electrode 13 and the nozzle body 8. These field lines fringe out into this general space as is covered in texts on electric fields and partially intercept the proximate product web 1. Electrical power for driving the high frequency generator is conveniently supplied via cable 47 from a remote direct current power supply 41.

Figure 3:
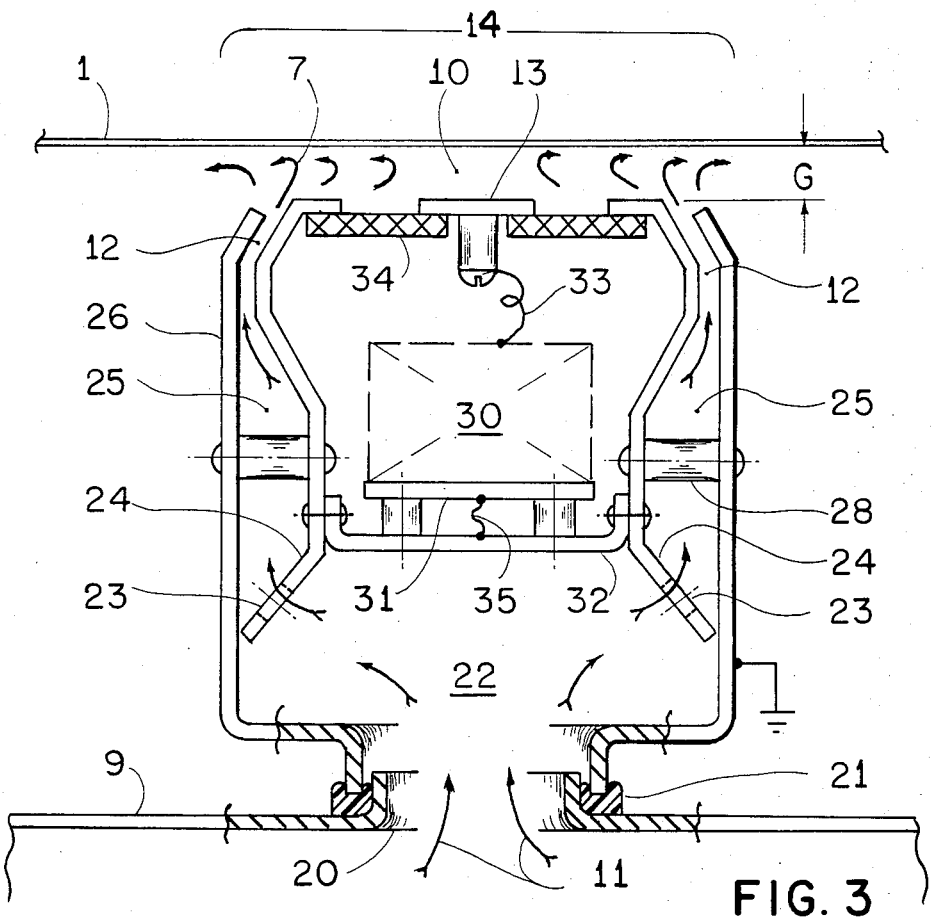
FIG. 3 is an end elevation of the nozzle bar of the invention with the end cap removed including a partial cross section of the treating gas inlet aperture.

A more detailed view is shown in FIG. 3. This figure shows an end elevation of the nozzle body of this invention with the end cover removed. The product web 1 is positioned above the working face of the R.F. enhanced nozzle bar assembly at a gap spacing G typically about 0.062 to 0.500 inches. Conditioned air 11 enters the bar assembly via the connecting aperture 20, shown here in section for clarity. Usually some type of locating collar and air sealing gasket 21 are provided to prevent air leakage. The air first enters a plenum or distribution chamber 22 inside the body of the bar. From this space it can communicate along the length of the nozzle bar assembly and be distributed to the nozzles slots in a uniform manner. Uniformity in the design shown is improved by providing a small pressure drop by means of a series of distribution holes 23 along the length of the skirts of the internal baffles 24. After passing through the distribution holes, the air flows upward in the spaces 25 between the walls formed by the outer housing 26 and the inner baffles 24. From the spaces 25, the air flow continues to the impingement nozzles 12 which, for the design shown, are slot orifices whose sides are formed from extensions of the housing body 26 and the baffle plates 24. The slow width is generally narrower than approach channel spaces 25 and is sized to provide the desired volume of air flow for the design value of jet velocity. The spacers 28 which are spaced at intervals along the housing wall illustrate one method of fastening the assembly and providing rigidity for the nozzle gap. Internal air pressure in the duct 9 might range up to approximately several inches of water pressure to provide commercially useful impingement velocities. As the air 7 issues from the nozzle orifices 12 to impinge on the product web 1, it is provided with a component of inward velocity to oppose that of the jet from the other side. This helps create a higher pressure zone 10 across more of the proximate working face 14 of the nozzle bar and thus both support the product web 1 and provide a restoring force to prevent a still wet web from mechanically contacting parts of the nozzle bar.

The electronic components of the high frequency generator are located inside the envelope of the structure as shown by the area 30. Those components may be mounted on a printed circuit board 31 or could be mounted directly on the septum plate 32. One output terminal of the oscillator circuit is electrically connected to the electrode bar 13 via a conductor 33. The other output terminal is connected to the nozzle body housing via conductor 35. Electrode 13 is supported on an insulating board 34 which provides for both the mechanical support and sealing of air leakage from the working face area 14. Practically, this insulating board 34 must be a high quality dielectric material which will have negligible dielectric loss at the frequency and electric field strength present in the area. Also, it should have adequate mechanical properties for the temperature and environment present in the area.

Figure 4:
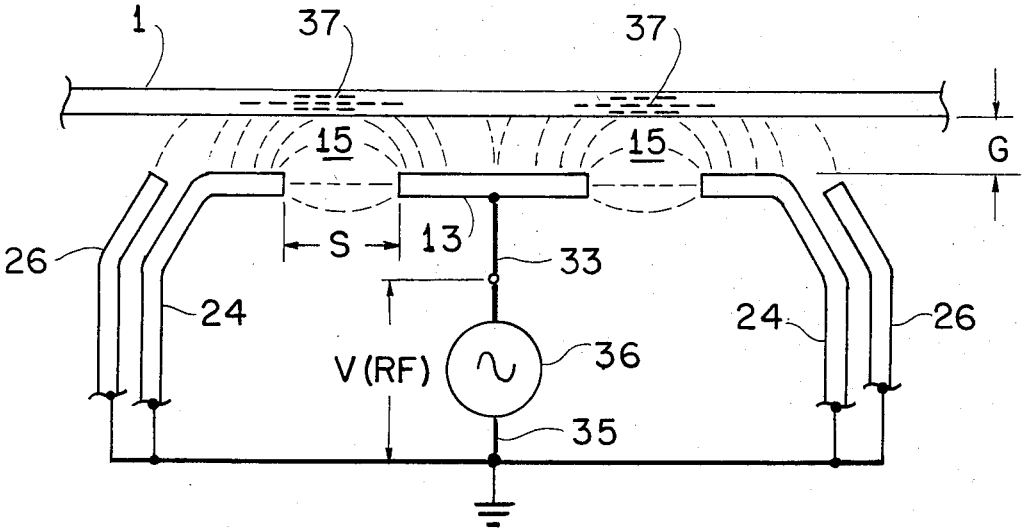
FIG. 4 is a partial view of FIG. 3 showing, schematically, the fringing radio frequency electric fields in the proximate space and their relationship to the process web.

FIG. 4 shows a schematic cross section view that more fully illustrates the positioning and dielectric heating action of the high frequency electric field that is established between the electrode 13 and the nozzle components 24 and 26. The R.F. generator circuit 36 creates a high frequency voltage V(RF) across its output terminals. One side is connected to the nozzle components, 24, 26, typically sheet metal parts, and conveniently tied to the machine frame electrical ground. The other R.F. generator terminal is connected to the electrically isolated electrode bar 13. This establishes fringing electric fields 15 in the electrically non-conductive dielectric space surrounding the conductors as indicated by the dashed lines in FIG. 4. If the product web 1 is in reasonable proximity, field lines will enter it and, in fact, will tend to be concentrated therein since the product, typically, will have a dielectric constant greater than the air and therefore present a lower dielectric impedance. The action of this field in the product is to cause a displacement electric current to flow in the product at each reversal of the applied field polarity. If the product web or its coating possesses a dielectric loss factor $e_r''$ of a reasonably high value, a useful portion of this alternating current flow will be transformed into heat directly in the body of the product. This heating effect will be concentrated in the areas of highest displacement current, typically the projection of the gap S between the electrode elements 13, 24 onto the web 1 in the regions indicated by 37.

One dielectric component not shown on FIG. 4 is the insulating support board 34 noted in FIG. 3. This was omitted from FIG. 4 for clarity. It will also intercept and concentrate a portion of the electric field 15. Because it is selected to possess a low dielectric loss factor, no significant heating of its material will occur. It will represent only a passive capacitance which may be electrically compensated in the R.F. generator circuit.

Figure 5A:
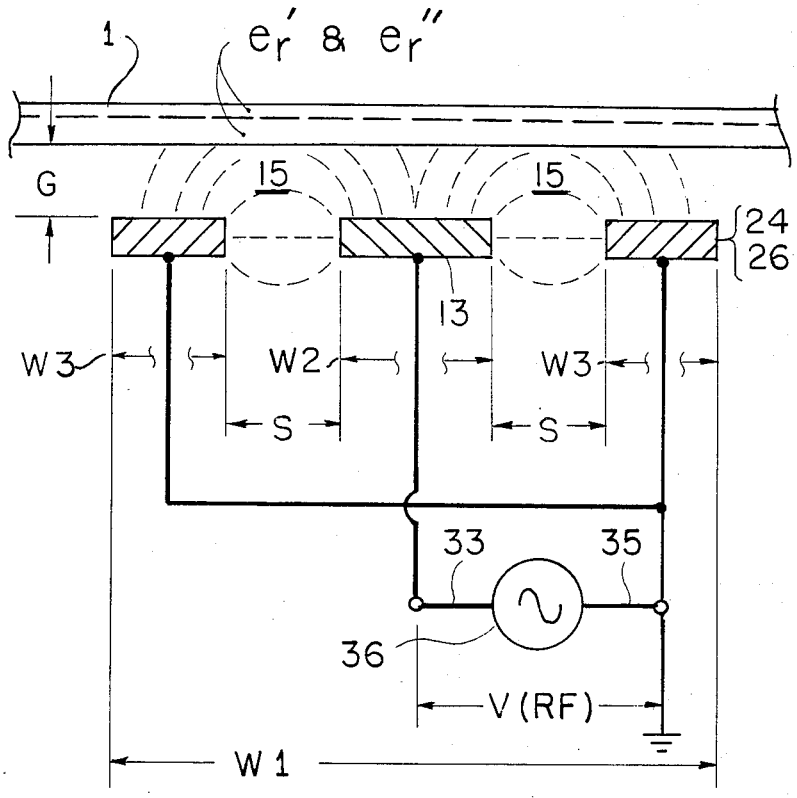
FIG. 5A is a schematic drawing of the elements of radio frequency electrodes showing the important coupling parameters.

Referring now to FIG. 5A, the schematic diagram shows the essential electrical components of two electrode gaps of an R.F. stray field electrode coupling system as might be used typically with the present invention. One objective of the design process is to obtain the maximum energy coupling for a given, acceptable electrode voltage V(RF) within the available working space, in this instance the width W1 of the working face 14 of the nozzle bar assembly. Such coupling depends on the parameters of the average gap G, the electrode spacing S, the effective electrode widths W2 and W3, and the dielectric constant $e_r'$ and loss factor $e_r''$ of the product load 1. Usually, the coupling characteristics are best determined by laboratory tests on mockups and the results will permit the designer to proportion the electrode widths W2 and W3 and the spacing S for optimum results. Typically, as the the gap G gets smaller, the optimum values for the spacing S and widths W2, W3 get smaller. Thus, if the application involves a product web running very close to the working face of the nozzle bar, an optimum design may require the use of more than the two fringing fields shown in FIG. 5A. One such alternate arrangement is illustrated schematically in FIG. 5B wherein multiple isolated "hot" electrodes are placed on the face 14 interspersed with grounded electrodes which are part of that face.

Figure 5C:
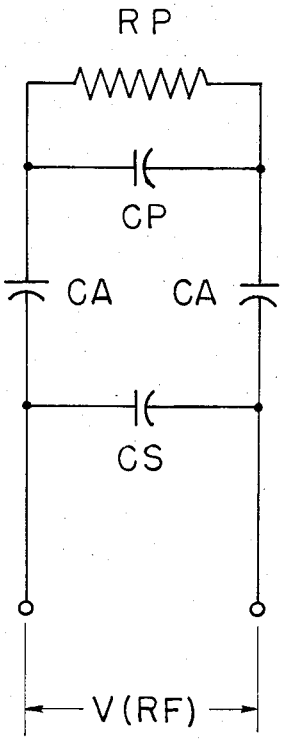
FIGS. 5C and 5D are equivalent electrical schematics of the electrodes shown in FIGS. 5A and 5B.
Figure 5B:
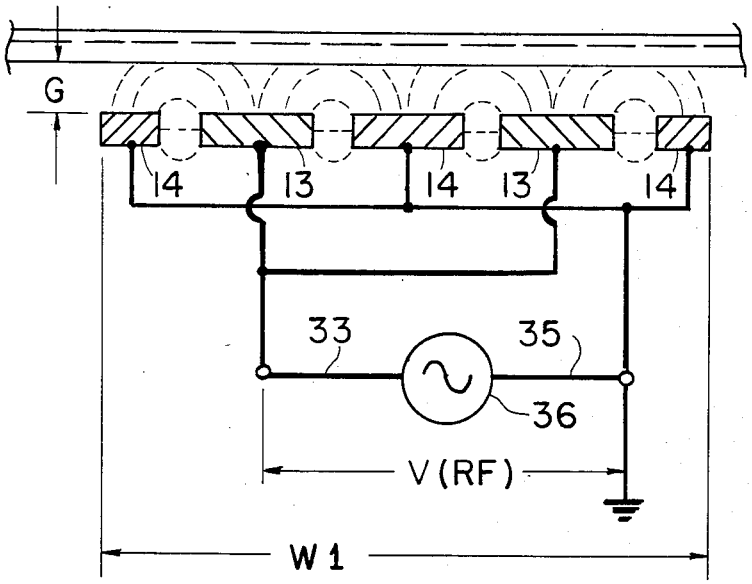
FIG. 5B is a schematic of multiple electrodes and fields placed within the working face of the nozzle bar.
Figure 5D:
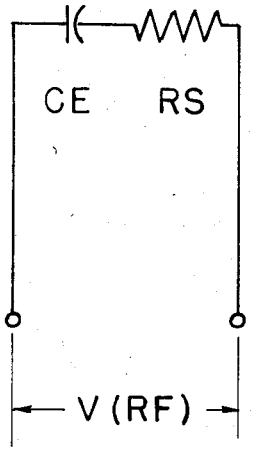

The electrical coupling of the arrangements shown in FIG. 5A and FIG. 5B may be represented reasonably by an equivalent electrical circuit shown schematically in FIG. 5C. In this circuit, CS represents the shunt capacitances of the air gaps S and support insulator 34 between the electrodes. CA represents the air gap capacitances between the face of the electrode bars and the product web. CP represents the combined capacitance of the product web and its coating and RP represents the the equivalent parallel electrical loss of that same combination. For a given set of parameters and a given R.F. operating frequency, the equivalent circuit of FIG. 5C may be further simplified by standard electrical analysis techniques to that shown in FIG. 5D. In FIG. 5D, CE represents the equivalent capacitance of the load and RS represents the equivalent series loss resistance. This simpler form is useful in considering the load effects and the relationship between the voltage appearing across the electrodes V(RF) and the voltage supplied by the R.F. generator V(G). This will be used in later discussions covering an additional improvement of the present invention.

Figure 6A:
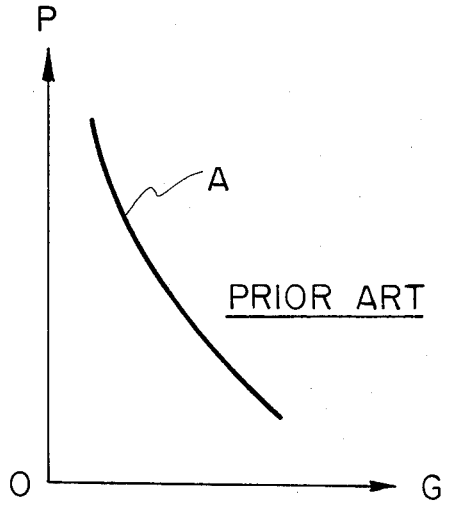
FIGS. 6A and 6C are graphic curves illustrating power coupling characteristics of different circuit arrangements.

In a typical dielectric web heater wherein multiple pairs of stray field electrodes are directly connected in parallel to the common R.F. generator, the capacitance of the electrode structure is the major capacitance of the generator's resonant tank circuit. In this arrangement, the electrodes, as pairs and as a group, tend to operate at essentially a constant voltage. That is to say, V(RF) in FIG. 5A or FIG. 5B is constant. This gives rise to a power transfer characteristic such as shown in FIG. 6A by curve A. As the gap distance G between the product web and the electrodes is increased, the power P transferred to the web decreases about as an inverse function. This is a natural consequence of holding the electric field gradient constant [V(RF)=constant ] and moving the film outward where it intercepts less and less of the electric field lines. It may be interpreted also in the schematic circuit of FIG. 5C as an increase in the impedances of CA. Prior art devices operate in this manner. For a typical drying machine, this gives rise to unpredictability in the performance because it is impossible to always control the web-to-nozzle bar spacing G in an exact manner. A variety of factors such as changes in web tension, web curling, and aerodynamic fluttering can all conspire to periodically change the gap G in an unpredictable manner.

Figure 6B:
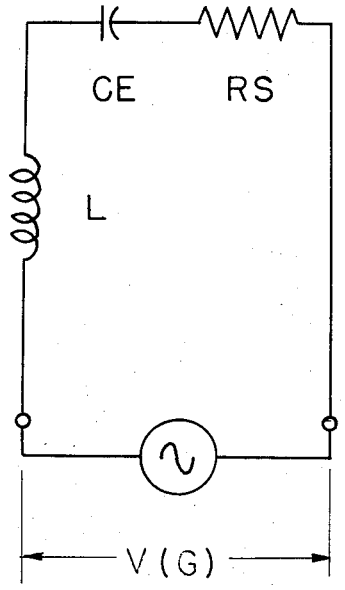
FIGS. 6B and 6D show electrical schematics of two series connection arrangements with the R.F. generator.

In the present invention, the electrode circuit as represented by CE and RS of FIG. 5D is combined with a a series inductor L as shown in FIG. 6B. The value of the series inductor L is selected so that L and CE are series resonant at the operating frequency F. As is covered in standard electrical engineering texts, such a circuit has a number of distinct characteristics. First, when driven at its resonant frequency, the alternating voltage V(RF) appearing across CE and RS, which is the voltage across the electrodes, can be much larger than the driving voltage V(G) of the generator which is applied to the input terminals of the circuit. More specifically, the electrode voltage V(RF) is equal to the generator voltage V(G) multiplied by the circuit quality factor Q. This quality factor Q for resonant circuits is covered in standard electrical circuit texts and may be enumerated for the series circuit by dividing the circuit reactance of either inductor L or capacitance CE by the total series circuit resistance. This voltage gain characteristic provides a practical engineering convenience by supplying a method of obtaining the several hundred to several thousand volts desired across the electrodes from a solid state high frequency generator which most practically is operated at D.C. supply voltages from about 12 to 50 volts.

Figure 6C:
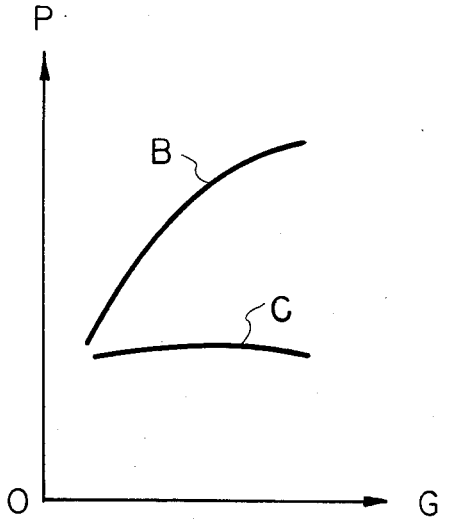

With the circuit arrangement of FIG. 6B, assuming the R.F. generator voltage V(G) is constant, the power transfer characteristics are shown on FIG. 6C on the curve labeled B. As shown, the power transfer actually increases as the the gap increases. This is because, as the gap increases, the equivalent series loss resistor RS decreases in value, Q increases, and the electrode voltage V(RF) increases. Because the dielectric heating effect increases as the square of the electric field strength, the effect is to increase the power coupling as the gap increases and the generator voltage V(G) is held constant.

Figure 6D:
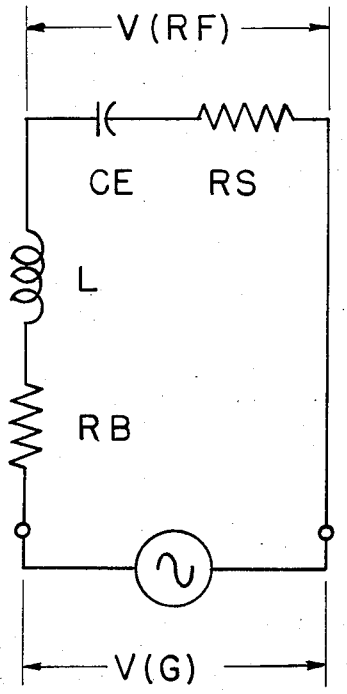

A power transfer that rises with increasing gap could be as troublesome as the falling characteristic shown in FIG. 6A. Also, it might lead to excessively high electrode voltages and arcing if the load loss represented by resistor RS gets too low. An element of the present invention is the addition of a fourth element in the output circuit to provide a more desirable characteristic. This is the addition of a ballast resistance RB in the series resonant output circuit shown in FIG. 6D. With the addition of this element, when sized appropriately, a power coupling characteristic as shown in curve C of FIG. 6C can be obtained. The arrangement of FIG. 6D thus can be made to provide substantially constant power transfer to the product web even as the gap varies over its practical extremes. This characteristic is obtained because the added ballast resistor places limits on how fast the circuit Q can rise as the load moves into a lower field region. Thus, the electrode voltage rises at a rate just sufficient to maintain the substantially constant coupling.

It will be realized that the ohmic R.F. impedance of the ballast resistor RB does not have to be lumped in one discrete component but may utilize the inherent residual losses of the inductor L or the general circuit conductors to form part or all of the required value.

The addition of this feature providing substantially constant power transfer to the product web provides the process operator with a system which will exhibit more predictable drying rate performance and more operating tolerance relative to the various factors affecting the web positioning.

Figure 7:
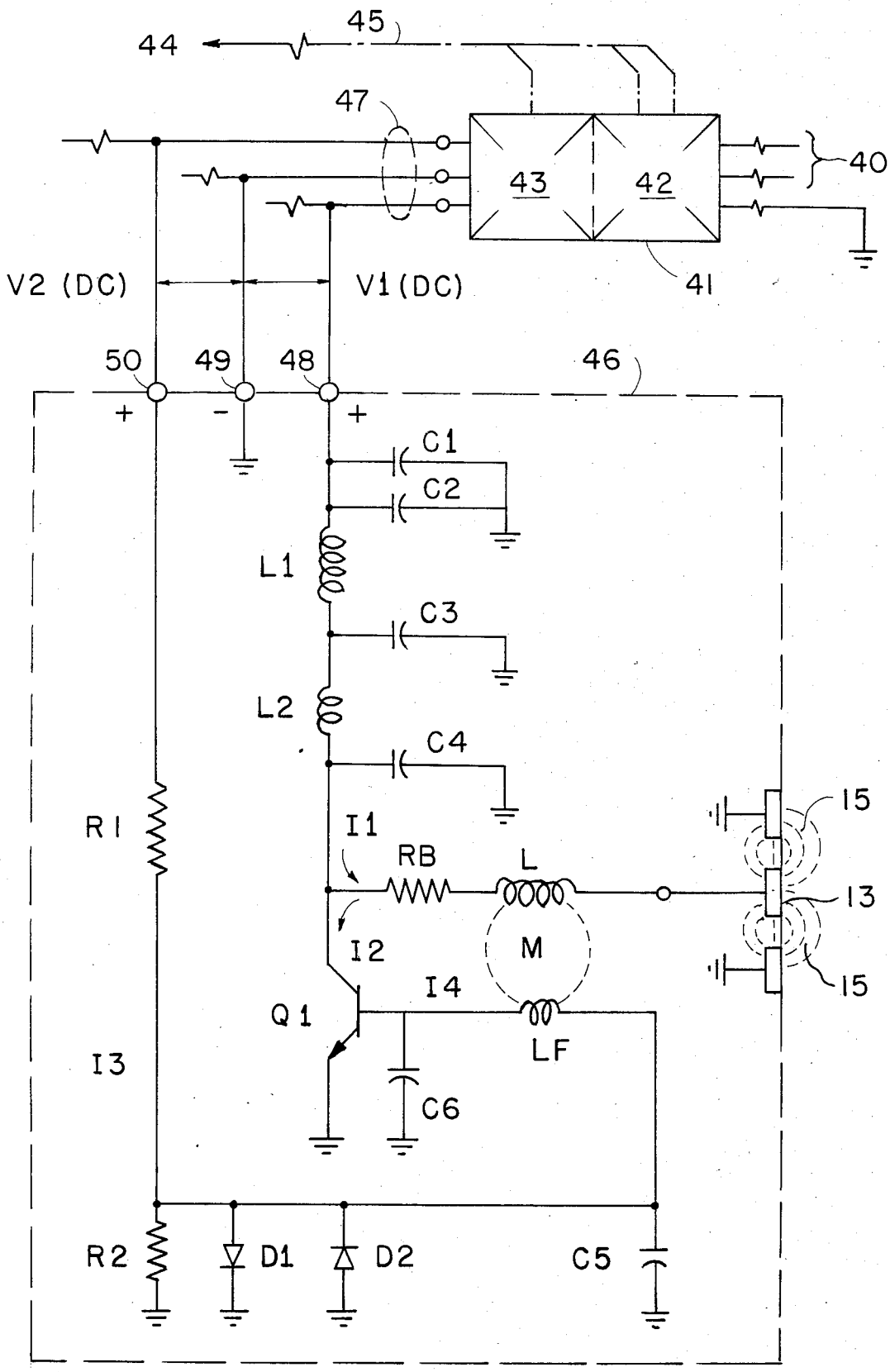
FIG. 7 shows an electrical circuit schematic of the R.F. generator and connections for the preferred embodiment of the invention.

FIG. 7 shows a schematic drawing of one radio frequency generator system which is the preferred embodiment of the present invention. Referring to this diagram, electrical power is conveniently supplied from single or multiple phase plant mains 40 by normal practice. It enters a power supply 41 which is conveniently a separate assembly and located outside the dryer tunnel 4 as illustrated in FIGS. 1 and 2. In one portion 42 of the power supply 41, the incoming mains power is transformed into one or more direct current sources whose voltage may be fixed or adjustable. The power supply may also contain additional circuitry 43 to monitor current flow or other parameters of interest. Optionally, voltage level adjustment, current monitoring, on/off control, et cetera may all be handled at a remote location 44 via electrical cabling 45. Such a remote location might be a process control room or computer. All the power supply actions mentioned are well known in the existing art.

The output of the D.C. power supply 41 is connected to one or more R.F./nozzle bar assemblies of the invention. In this figure, the electrical elements of one such bar are those shown enclosed by the dashed line 46. The connection between the power supply 41 and a nozzle bar electrical elements 46 could be accomplished conveniently by a multi-conductor insulated cable 47. The primary D.C. power flow V1(DC) enters the individual nozzle bar assembly elements 46 via the terminal 48. For the particular circuit devices used in this illustration, the terminal 48 would have a positive polarity. From terminal 48, the current flows through a low pass network composed of the capacitors C1, C2, C3, and inductor L1. The function of this conventional network is to pass the average D.C. power easily into the R.F. oscillator circuit while preventing the high frequency power present in the oscillator from flowing backward into the power supply. The generation of high frequency oscillations is accomplished by the combination of the active solid state transistor Q1, feedback inductor LF, and the the series resonant output circuit. The series resonant output circuit is composed of the series inductor L and the capacitance and equivalent load loss resistance of the applicator electrode 13, these latter being represented in FIG. 6B as CE and RS. The oscillator action is relatively conventional and is well covered in electrical engineering texts. Briefly, the action proceeds as the following sequence. Assume the transistor Q1 is near cutoff and a rising current I1 is flowing into the series resonant output circuit. As it passes through the series inductor L, a magnetic mutual coupling M between it and the feedback inductor coil LF induces a voltage in coil LF. The phasing of the coils is such that this voltage acts to further reduce the base current of Q1 and thus drive it further into cutoff. This action continues until current saturation of the output circuit occurs controlled by its ohmic impedances. At this point the induced voltage in LF drops to zero and then begins to reverse. The action of the reversal is to increase the base current in the transistor Q1 and start it into its conductive state. As Q1 becomes conductive, it provides a return current path I2 for the current I1 which earlier flowed into and charged the output circuit. This current can now flow to the electrical ground via transistor Q1 and complete the circuit back to the power supply 41 via terminal 49. Finally, the capacitance of the output circuit is discharged and the feedback voltage again reverses. This starts the cycle again.

The combination of the inductor L2 and capacitor C4 form a parallel resonant circuit which is broadly resonant at the operating frequency of the oscillator. This provides further isolation of the oscillator from the power supply and serves also as the source for the pulses of radio frequency current used to charge the series resonant output circuit at each cycle.

A second D.C. source input V2(DC) enters assembly 46 via terminal 50. Its function is to provide an initial base drive current I3 to the transistor Q1. This is necessary to provide an initial quiescent circuit gain so that oscillations may start spontaneously. The amount of the initial base drive is controlled by the input voltage V2(DC), and resistors R1 and R2. After circuit oscillations begin, the R.F. component of the feedback signal flows through bypass capacitor C5 and is partially rectified at the base-emitter junction of transistor Q1. This action, in conjunction with resistor R2 and diodes D1 and D2, resets the transistor operating bias current I4 to provide for operation in the class C region. The meaning and characteristics of class C operation are well covered in the art. The opposed diodes D1 and D2 provide also a limiting action to protect the transistor base-emitter junction from excessive voltage after strong oscillations start.

The small capacitor, C6 which is connected across the base-emitter junction of the transistor Q1 works in conjunction with the residual inductance of the transistor base lead not shown in this diagram. The combination serves to match the electrical impedance of the feedback signal with the impedance of the base-emitter junction as is known in the art. The action of the ballast resistor RB is to provide the output circuit with the constant power transfer characteristic explained earlier and illustrated by curve B of FIG. 6C.

The transistor used in this circuit must be suitable for service at the circuit operating frequency. Generally, this will mean a transistor specifically designed for adequate gain and required power output at the operating R.F. frequency. Newer types of field effect transistors are also good candidates for this service.

A typical set of component and operating values for the circuit in practical service are as follow:

| | |
|---|---|
| Nozzle Bar length | 18 inches |
| No. of "hot" electrodes | 1 |
| Q1 Output power | 100 to 150 watts |
| Voltage V1 (DC) | 28 volts DC |
| Voltage V2 (DC) | 0 to 10 volts |
| Operating Frequency (ISM) | 27.12 Megahertz |
| C1 | 5 microfarads |
| C2, C3, C5 | .01 microfarads |
| L1 (R.F. Choke) | 5 turns #22 .25" I.D. |
| L2 (Resonator) | 1.5 turns #22 .25" dia. |
| C4 | 68 picofarads |
| C6 | .05 microfarads |
| Q1 | MRF-327 |
| R1 | 180 ohms |
| R2 | 10 ohms |
| D1, D2 | 1N4005 |
| L | 11 T #12 1.5" I.D. |
| LF | 2 T #12 1.5" I.D. |
| RB | 5 ohms |

It will be recognized by those familiar with circuit design that there are innumerable variations possible in the design of electronic power oscillators. The design shown is practical for the given application but could easily be changed as needed. For example, requirements for longer nozzle bars of higher electrical power may require the use of multiple transistors in parallel. Also, progress in the design of such devices is rapid and newer units might be used as they become available and offer technical advantages. It is also likely that the power supply for a given application may include additional safety and convenience features known in the art. These might include current limiting to prevent excessive electrode voltage excursions as the load RS decreases, thermal overload protection, et cetera.

What is claimed:

1. In a nozzle bar for treating a web with a gas, an electrically conductive structural housing comprising an internal gas distribution plenum connected to a source of treating gas and a perforate surface in proximity to the web for directing the gas flow from the bar upon the web; the improvement comprising at least one electrode insulatedly mounted on the perforate surface of the nozzle bar and a radio frequency power source electrically connected between the electrode and the nozzle bar housing whereby establishing a plurality of fringing radio frequency fields between said electrode and the structural housing; such fields substantially confined to the proximate space of the perforate surface and the web and intercepting the proximate web and transfering heating energy from the R.F. source to the web.

2. The nozzle bar of claim 1 wherein the source of the radio frequency power is mounted within the structural housing of the nozzle bar.

3. The nozzle bar of claim 1 wherein the source of radio frequency power comprises circuit means to generate R.F. power and means to maintain substantially constant power transfer between the radio frequency power generator and the web during normal variations in web to nozzle bar spacing.

4. The nozzle bar of claim 3 wherein the means to maintain constant power transfer comprises an inductor and ballast resistance in series connection with the capacitance of the electrodes, and the radio frequency power generator having an output voltage set at a nominally constant value and having a frequency the same as the series resonant frequency of the inductor, ballast resistance, and electrodes.

5. Apparatus for treating webs and the like comprising a controlled web path, an enclosure for controlling the treating environment, a source and exhaust for gaseous treating fluid and in combination, at least one perforate surface electrically conductive nozzle bar structure, the perforate surface incorporating means to direct the treating gaseous fluid onto the web, and the structure incorporating means to establish a plurality of fringing radio frequency electric fields substantially confined to the proximate space between the perforate nozzle bar surface and the web whereby the fringing fields transfer energy from the field to the web, the means to establish the fields comprising at least one electrode insulatedly mounted on the perforate surface of the structure and a radio frequency power generator electrically connected between the electrode and the structure.

6. The apparatus of claim 5 wherein the gaseous treating fluid serves also to provide mechanical positioning or support of the web.

7. The apparatus of claim 5 wherein the radio frequency power generator is located inside the structure of the perforate surface nozzle bar.

8. The apparatus of claim 5 wherein the means to establish the fringing radio frequency electric fields additionally comprises electrical means to sense variations in the web-to-nozzle bar gap and alter the strength of the electric fields such as to maintain substantially constant power transfer from the radio frequency power source to the web over the normal range of gap variation.

* * * * *